US009347210B2

(12) United States Patent
Delgigante et al.

(10) Patent No.: US 9,347,210 B2
(45) Date of Patent: May 24, 2016

(54) APPLICATOR FOR AN ADHESIVE LAVATORY TREATMENT COMPOSITION

(75) Inventors: Jesse Delgigante, Montvale, NJ (US); Elizabeth Goodrich, Cambridge, MA (US); Peter Swai, Cambridge, MA (US); Kristin Jugenheimer Size, Cambridge, MA (US); Gary Palladino, Cambridge, MA (US); Ardite Francesc Ayats, Barcelona (ES); Richard Loring Miller, Cambridge, MA (US)

(73) Assignee: Reckitt Benckiser LLC., Parsippany, NJ (US)

( * ) Notice: Subject to any disclaimer, the term of this patent is extended or adjusted under 35 U.S.C. 154(b) by 209 days.

(21) Appl. No.: 13/642,187

(22) PCT Filed: Apr. 28, 2011

(86) PCT No.: PCT/GB2011/050839

§ 371 (c)(1),
(2), (4) Date: Jan. 25, 2013

(87) PCT Pub. No.: WO2011/135365

PCT Pub. Date: Nov. 3, 2011

(65) Prior Publication Data

US 2013/0117917 A1 May 16, 2013

(30) Foreign Application Priority Data

Apr. 28, 2010 (GB) ..... 1007064.7

(51) Int. Cl.
*E03D 9/02* (2006.01)
*B65D 83/00* (2006.01)

(52) U.S. Cl.
CPC ..... *E03D 9/02* (2013.01); *B65D 83/0005* (2013.01)

(58) Field of Classification Search
CPC ..... E03D 9/032; E03D 2009/024; E03D 2009/026
USPC ..... 4/231, 232; 222/386
See application file for complete search history.

(56) References Cited

U.S. PATENT DOCUMENTS 4,782,983 A 11/1988 Cook
6,667,286 B1 12/2003 Dettinger et al.

(Continued)

FOREIGN PATENT DOCUMENTS

DE 20217554 U1 4/2004
DE 102009051129 A1 * 6/2011

(Continued)

OTHER PUBLICATIONS

English machine translation for WO 03/043906 A1 dated Apr. 20, 2015.*

(Continued)

*Primary Examiner* — Huyen Le
*Assistant Examiner* — Christine Skubinna
(74) *Attorney, Agent, or Firm* — Norris McLaughlin & Marcus PA

(57) ABSTRACT

Disclosed is an applicator for an adhesive lavatory treatment composition. The applicator comprises a quantity of an adhesive lavatory composition, a piston part moveably engageable with a base part, wherein the piston part includes a piston plate and a grip element, the base part includes an upper cavity, and a lower cavity, wherein the piston plate is fitted within the upper cavity of the base part and is moveable within the upper cavity of the base part. The applicator may be a single use applicator adapted to dispense only a single dose of an adhesive lavatory treatment composition, or may be a multi-use applicator which may be refilled and reused to deliver plural doses of an adhesive lavatory treatment composition.

10 Claims, 5 Drawing Sheets

(56) References Cited

U.S. PATENT DOCUMENTS

| | | | | |
|---|---|---|---|---|
| 7,520,406 | B2 * | 4/2009 | Jaichandra et al. | 222/47 |
| 2006/0263140 | A1 | 11/2006 | Tani | |
| 2007/0007302 | A1 | 1/2007 | Jaichandra et al. | |
| 2007/0106210 | A1 | 5/2007 | Fischer | |
| 2007/0187437 | A1 * | 8/2007 | Lord | 222/568 |
| 2008/0190457 | A1 | 8/2008 | Veltman et al. | |
| 2012/0223360 | A1 * | 9/2012 | Barchmann et al. | 257/99 |
| 2013/0117917 | A1 | 5/2013 | Delgigante et al. | |

FOREIGN PATENT DOCUMENTS

| | | | |
|---|---|---|---|
| EP | 1978080 | A1 | 10/2008 |
| EP | 2141221 | A1 | 1/2010 |
| WO | 03043906 | A1 | 5/2003 |
| WO | 2004043825 | A1 | 5/2004 |
| WO | 2007008531 | A1 | 1/2007 |

OTHER PUBLICATIONS

International Search Report for PCT/GB2011/050839 dated Aug. 12, 2011.

Wriiten Opinion if the International Searching Authority for PCT/GB2011/050839 dated Aug. 12, 2011.

English Language Translation for DE 20217554U1 dated Apr. 29, 2004.

GB Search Report for GB 1007064.7 dated Oct. 21, 2010.

International Search Report for PCT/GB2011/050765 dated Jul. 5, 2011.

Wriiten Opinion if the International Searching Authority for PCT/GB2011/050765 dated Jul. 5, 2011.

GB Search Report for GB 1007066.2 dated Jun. 25, 2010.

* cited by examiner

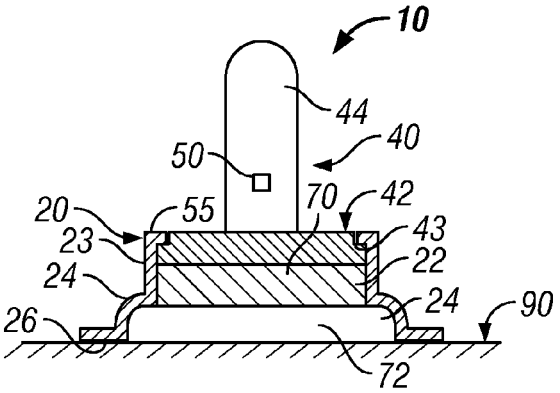
FIG. 4A1
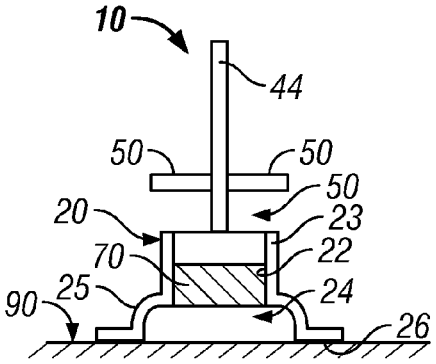
FIG. 4B1
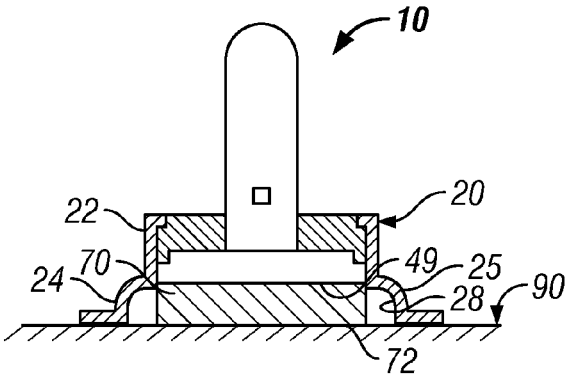
FIG. 4A2
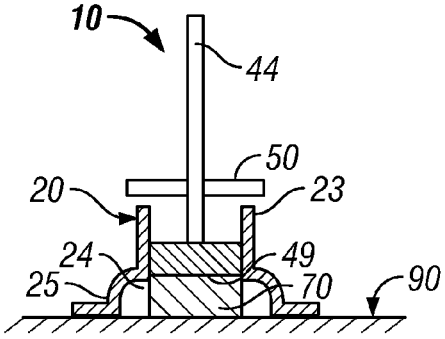
FIG. 4B2
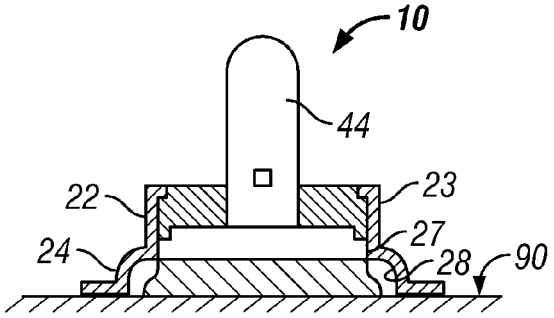
FIG. 4A3
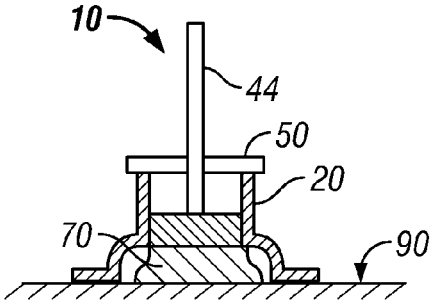
FIG. 4B3

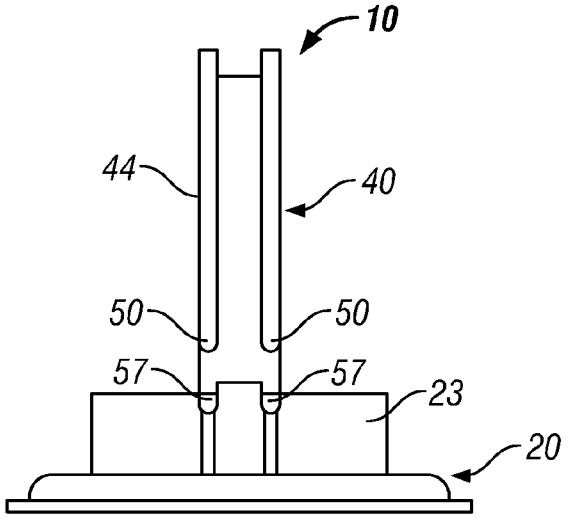
FIG. 6A1
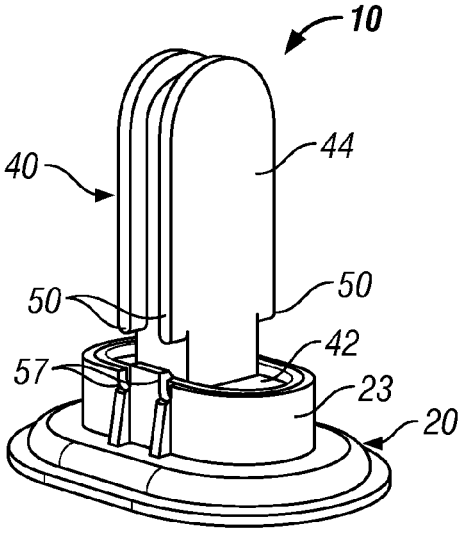
FIG. 6A2
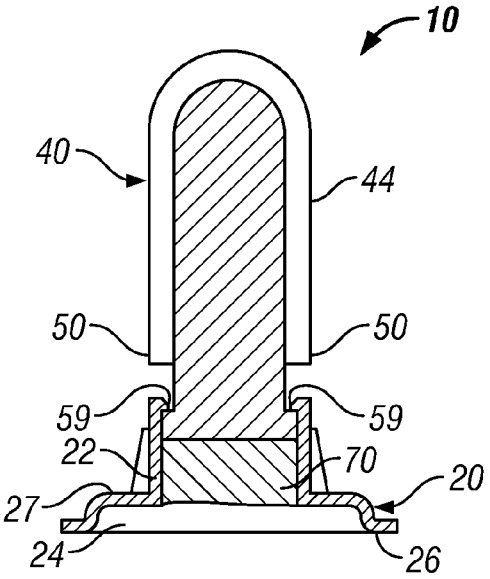
FIG. 6A3
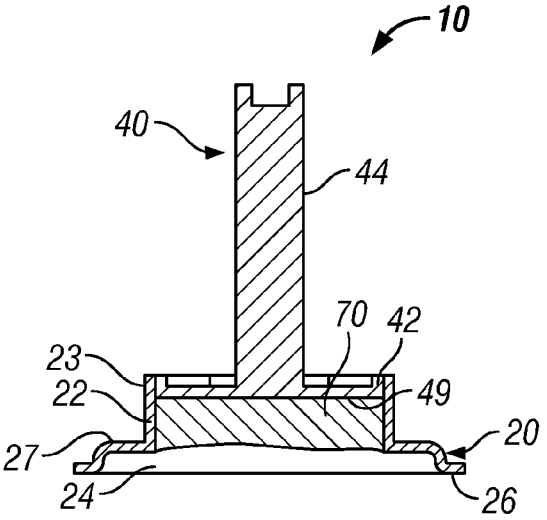
FIG. 6A4

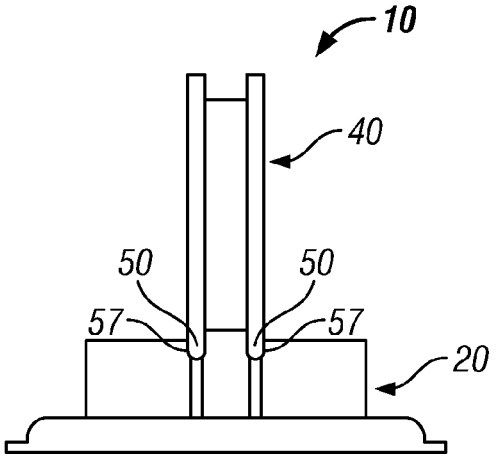
FIG. 6B1
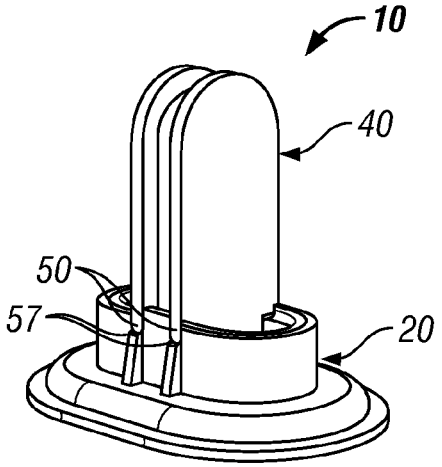
FIG. 6B2
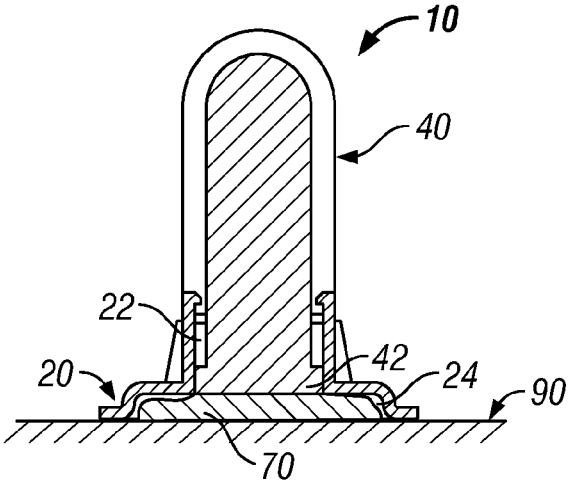
FIG. 6B3
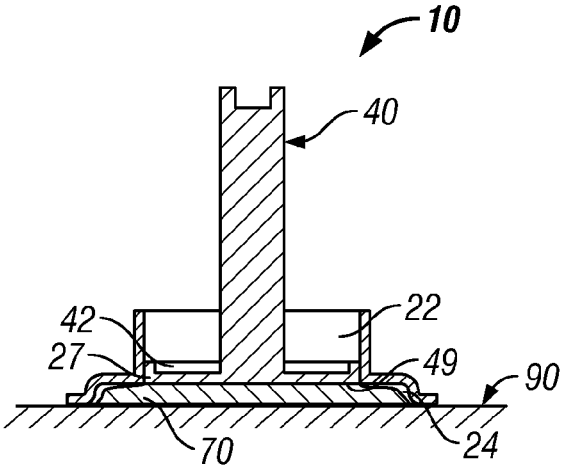
FIG. 6B4

APPLICATOR FOR AN ADHESIVE LAVATORY TREATMENT COMPOSITION

This is an application filed under 35 USC 371 of PCT/GB2011/050839.

The present invention relates to an applicator for an adhesive lavatory treatment composition.

Lavatory treatment compositions, namely compositions which comprise one or more chemical constituents which are intended to provide one or more technical benefits to lavatory appliance are well known to the art. These include without limitation: liquid treatment compositions, solid treatment compositions particularly those which are intended to be provided as solid blocks, cakes, tablets, pastes, or self-supporting gels which may be provided to the upper tank or cistern of a toilet, or provided to a part of a toilet bowl such as when provided in a suitable dispensers such as a cage, are well known to the art. Such lavatory treatment compositions can provide as technical benefits one or more of, e.g., a cleaning benefit, a disinfecting benefit, sanitizing benefit, an anti-resoiling resistant benefit, a fragrancing benefit, and/or an air treatment benefit. Provision of two or more technical benefits are also known to the art.

More recently, so-called "adhesive lavatory treatment compositions" have been introduced to the art. These are generally pastes, or gels which may be directly applied to a portion of a toilet or other lavatory appliance. Such adhesive lavatory treatment compositions include, inter alia., those disclosed in U.S. Pat. No. 6,667,286 B1 as well as those disclosed in US 2008/190457. Such adhesive laboratory treatment compositions are intended to be applied directly to a wetted or wettable surface of the lavatory appliance, particularly to the interior sidewall of a toilet bowl. In use, said compositions are said to resist being washed away when flushed with water such as during a normal flushing operation. Such resistance to being washed away may vary over time and/or the number of flushes to which an adhered lavatory treatment composition is subjected.

Such adhesive lavatory treatment compositions however require that they be applied to a surface. Due to the sticky or adhesive nature of said compositions, an applicator of some type is typically required. Such have also been proposed in the art. For example, an applicator disclosed in U.S. Pat. No. 7,520,406 provides a means whereby multiple doses of adhesive lavatory treatment composition may be applied before the quantity of said composition provided by the applicator is exhausted. A further, simpler applicator is disclosed in US 2008/190457 which provides a pouched single-dose mass of an adhesive lavatory treatment composition which may be manually applied by a consumer. While this latter simple applicator is studied to provide a useful device for dispensing a unit dose, disadvantageously it requires consumers to come into very close proximate contact, or indeed to come into direct contact with, the interior surface of a toilet bowl. Such is disliked by many consumers. Furthermore, the pouched single-dose mass disclosed in US 2008/190457 and methods of its application are strongly dependent upon the placement of the single-dose mass, as well as the application of pressure transmitted through one or more fingers of the consumer applying the said single-dose mass in order to ensure proper application. However, this is highly variable between consumers and may not lead to a high probability of successful application of the single-dose mass of an adhesive lavatory treatment composition to a surface.

It is to these and further limitations in the art that the present invention is directed.

A first aspect of the present invention provides an applicator for an adhesive lavatory treatment composition.

A second aspect of the present invention provides a single use applicator for an adhesive lavatory treatment composition.

A third aspect of the present invention provides a method for applying adhesive lavatory treatment composition, preferably a single dose or unit dose of said composition to the surface of a lavatory appliance.

A fourth aspect of the present invention provides a method for the manufacture of an applicator for an adhesive lavatory treatment composition, preferably a single use applicator for said adhesive lavatory treatment composition.

Figure 1:
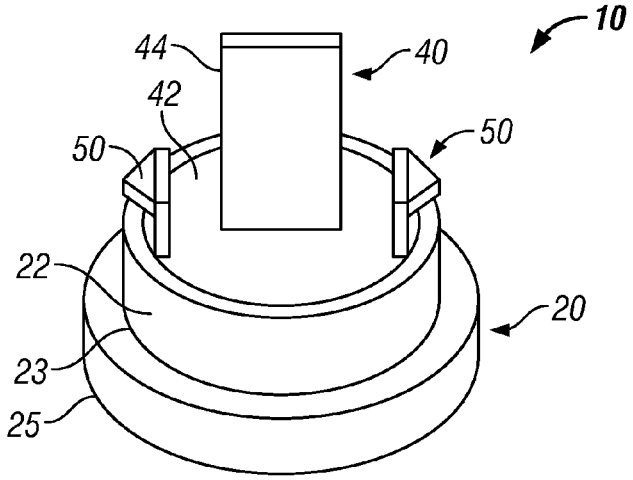
FIG. 1 depicts a perspective view of a first embodiment of an applicator of the invention.
Figure 2:
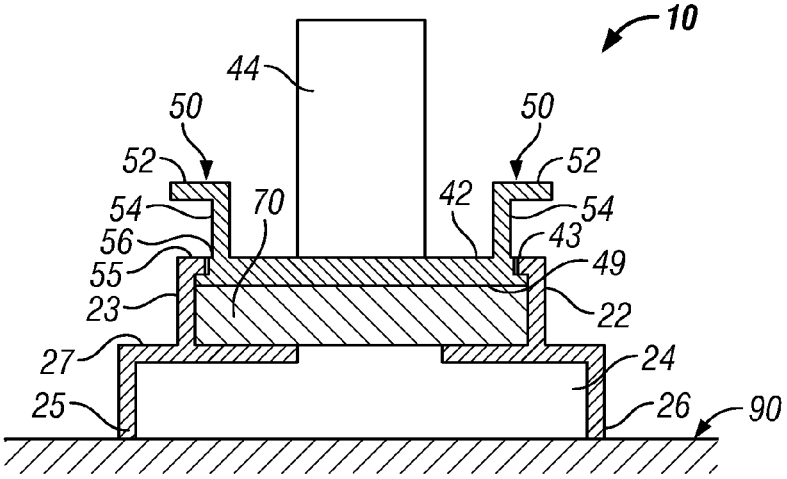
FIG. 2 is a cross sectional view of the applicator of FIG. 1.

FIGS. 4A1, 4A2, 4A3, 4B1, 4B2 and 4B3 illustrate various cross-sectional views of the applicator of FIG. 2 in a plurality of different configurations.

FIGS. 5A, 5B, 5C and 5D illustrate a method of applying a unit dose of an adhesive lavatory treatment composition using an applicator according to FIG. 2 to the inner sidewall of a toilet bowl.

FIGS. 6A1, 6A2, 6A3, and 6A4 illustrate various view of a further embodiment of an applicator of the invention in a first configuration, while FIGS. 6B1, 6B2, 6B3 and 6B4 illustrate further view of the embodiment in a second configuration.

These and further aspects of the invention will be understood from consideration of the following specification and accompanying drawings.

The applicators of the present invention may be used to dispense known-art adhesive lavatory treatment compositions, e.g., treatment compositions as disclosed in U.S. Pat. No. 6,667,286 B1 as well as disclosed in US 2008/190457, as well as U.S. patent application _, the contents of each of these documents being herein incorporated by reference. It is contemplated that virtually any solid, gel, or paste lavatory treatment composition which can be effectively retained within the applicators described herein, and thereafter be applied to a surface fall within the scope of the present invention.

In preferred embodiments, applicators of the invention are single use applicators intended to dispense a single mass or quantity of an adhesive lavatory treatment composition, after which parts of, or all of said applicator are disposed without refilling of the applicator. In such manner, a specific mass, or metered quantity of an adhesive lavatory treatment composition is provided within each applicator, and with each use, most, or all of the said composition is delivered from the said applicator, and onto a surface, particularly an inner sidewall of at lavatory appliance, particularly an inner sidewall of a toilet bowl.

In other, albeit lesser preferred embodiments, the applicators of the invention may be used two or more times in the delivery of quantities of an adhesive lavatory treatment composition before being discarded, disposed of, or refilled with a fresh quantity of an adhesive lavatory treatment composition and thereafter reused.

Various configurations of the inventive applicators according to the present invention, including certain particularly preferred embodiments, are depicted on the following figures. In the accompanying figures, like elements are indicated using the same numerals throughout the figures.

FIG. 1 depicts a perspective view of a first embodiment of an applicator 10 of the invention. The applicator is a two-part applicator comprising a base section 20 movably engageable with a piston part 40. The piston part 40 includes a piston plate 42 which is fitted within an upper cavity 22 of the base section 20. The piston part 40 also includes a grip element 44 here in the shape of a paddle which is adapted to be gripped by a user of the applicator 10 when applying an adhesive lavatory treatment composition, and preferably the grip element 44 is perpendicular to the piston plate 42. The grip element 44 is depicted to be generally perpendicular to the base section 20 but any other configuration of either of these parts is permitted. Optionally, but preferably as a shown in FIGS. 1 and 2 the piston part 40 also includes a pair of stop means 50. Each of the stop means 50 includes a base 56, a stalk 54 and an offset head 52 which last element extends outwardly from the grip element 44. The base section 20, according to preferred embodiments is bell-shaped and includes a first or upper cavity 22 and a second or lower cavity 24, which terminates at a base face 26. In the depicted embodiment, the first or upper cavity 22 is defined by a first circular sidewall 23, a bottom face 49 of the piston plate 42 and the second or lower cavity 24, which in turn is defined by a second circular sidewall 25, a transition section 27 which also delimits the interface between that first or upper cavity 22 and the second or lower cavity 24, and the base face 26. The first or upper cavity 22 and the second or lower cavity 24 also define a piston bore, which is narrower above, but expands at the transition section 27. Such is more clearly understood with reference now to FIG. 2 which is a cross sectional view of the applicator 10 of FIG. 1. As visible on FIG. 2, the piston plate 42 extends transversely within the first circular sidewall 23. To limit the withdrawal of the piston part 40 in the direction of the grip element 44, the applicator 10 includes a piston removal stop means, here a pair of cooperating elements, namely a circumferential recess element 43 present in the piston plate 42, here a step-like recess and a cooperating inwardly extending circular extension 55 extending from a part of the first circular sidewall 23. Thus the recess element 43 and the extension 55 delimit the removal of the piston part 40 from the base section 20 when pulled away therefrom. When the piston part 40 is moved in the direction of the base section 20, the pair of stop means 50 present are dimensioned such that a part thereof, here the offset heads 52 come into contact with part of the first circular sidewall 23 such that further inward motion of the piston part 40 and its base section 20 is halted. In preferred embodiments, the dimensions of the respective piston part 40, base section 20 and stop means 50 are desirably selected such that when the pair of stop means 50 (or part(s) thereof) engage a part of the base section 20 to thus halt further inward motion of the piston part 40, the bottom face 49 of the piston plate 42 is coincident with the transition section 27 which delimits the interface between that first or upper cavity 22 and the second or lower cavity 24. Thus in preferred embodiments, in a maximum compression configuration of the applicator, little or no part of the piston part 40 is present within the second or lower cavity 24. This is particularly advantageous as when considering preferred embodiments, wherein the cross-sectional area of the transverse of the first or upper cavity 22 is less than the cross-sectional area of the transverse of the second or lower cavity 24, controlling or limiting the movement of the piston plate 42 interest so that little of, or no part of the piston part 40 and especially the piston plate 42 enters into the second or lower cavity 24. The benefit thereof is discussed in greater detail in the following figures. Further, advantageously according to preferred embodiments the volume of the first or upper cavity 22 is also less than the volume of the second or lower cavity 24, the benefits of which are also discussed in greater detail in the following figures. FIG. 2 also illustrates a preferred placement of the applicator 10 on a surface 90 where the base face 26 abuts the surface 90. FIG. 2 also illustrates a mass of an adhesive lavatory treatment composition 70, here a single use "dose" thereof within the applicator 10. Specifically, according to this preferred embodiment the mass of the said composition 70 is confined between the piston part 40 and is contained within the first or upper cavity 22, and terminates at, or above of the transition section 27.

Figure 3:
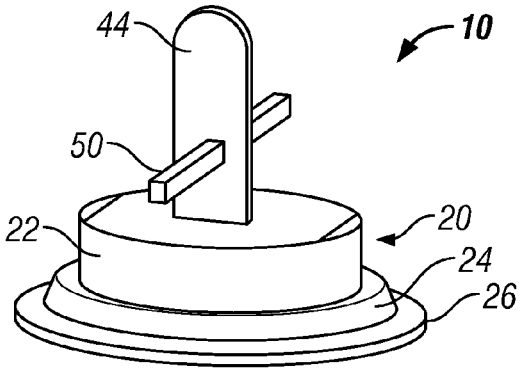
FIG. 3 depicts a perspective view of a second embodiment of an applicator of the invention.

FIG. 3 depicts a perspective view of a second embodiment of an applicator of the invention. The second embodiment differs in several respects from the first embodiment of FIG. 1, primarily in that whereas the piston plate 42, and the first or upper cavity 22 and the second or lower cavity 24 were circular in configuration, these elements in the second embodiment assume a more rectangular configuration with curved corners. Further, the stop means 50 comprises a pair of outwardly extending, generally perpendicular arms extending from opposite faces of the grip element 44. A more detailed understanding of the interrelationship of the various parts of the second embodiment, and a preferred mode of applying a mass of an adhesive lavatory treatment composition, here a single use "dose" thereof, is described with reference to FIGS. 4A1, 4A2, 4A3, 4B1, 4B2 and 4B3. Prior to discussing these figures it is to be understood is that said figures are presented as "paired" representations, namely FIG. 4A1 depicts a cross-sectional view of the applicator 10 from a side and FIG. 4B1 illustrates the same applicator of FIG. 4A1 but in a cross-sectional view from an end thereof, in a first configuration of the applicator 10. FIG. 4A2 depicts a cross-sectional view of the applicator 10 from a side and FIG. 4B2 illustrates the same applicator of FIG. 4B2 but in a cross-sectional view from an end thereof, in a second configuration of the applicator 10. FIG. 4A3 depicts a cross-sectional view of the applicator 10 from a side and FIG. 4B3 illustrates the same applicator of FIG. 4B3 but in a cross-sectional view from an end thereof, in a third configuration of the applicator 10. These respective views illustrate the relative positions of the piston part 40, base section 20, and of the mass of an adhesive lavatory treatment composition 70, here a single use "dose" thereof within the applicator 10 and with respect to the surface 90 in (A) an initial state prior to any movement of the piston part 40 within the base section 40, then (B) in an intermediate state prior to maximum movement of the piston part 40 within the base section 20, and when a bottom face 72 of the mass of an adhesive lavatory treatment composition 70 is in initial interfacial contact with the surface 90, then (C) the final state and subsequent to maximum movement of the piston part 40 within the base section 20, wherein the stop means 50 are engaged with parts of the base section 20 to deny further inward movement of the piston part 40, such that the bottom face 49 of the piston plate 42 is coincident with the transition section 27 which delimits the interface between the first or upper cavity 22 and the second or lower cavity 24 and further wherein the mass of the adhesive lavatory treatment composition 70 is both in interfacial contact with the surface 90 as well as also being deformed laterally, as depicted. Such also demonstrates that in preferred embodiments, in a maximum compression configuration of the applicator, little or no part of the piston part 40 is present within the second or lower cavity 24. As compression by the piston part 40 ensures good interfacial contact between the bottom face 72 of the mass of an adhesive lavatory treatment composition 70 and the surface 90 as ensured by the 'over-compression' evidenced by the visible lateral deformation of the mass of the adhesive lavatory treatment composition 70 when the applicator 10 is withdrawn by the consumer. At the same time, most desirably, the configuration of the elements of the applicator 10 and the mass/volume of the adhesive lavatory treatment composition 70 are selected such that when the piston part 40 is at its maximum displacement within the base section 20, as depicted on FIGS. 4A3 and 4B3, ideally none of the compressed and laterally deformed mass of the adhesive lavatory treatment composition 70 comes into contact with the interior 28 of the sidewall(s) 25 of the second or lower cavity 24. Such minimizes the likelihood of undesired adhesion between any other part of the applicator 10 other than the piston part 40 and preferably minimizes the likelihood of undesired adhesion between any other part of the applicator 10 other than the bottom face 49 of the piston plate 42. Such minimizes the likelihood that the applied mass of the adhesive lavatory treatment composition 70 will be inadvertently removed when the applicator 10 is withdrawn.

FIGS. 5A, 5B, 5C and 5D illustrate a method of applying a unit dose of an adhesive lavatory treatment composition using an applicator according to FIG. 3 to the inner sidewall of a toilet bowl. As is visible thereon, in FIG. 5A an applicator 10 generally similar to that described with reference to FIG. 3 is manually grasped by its grip element 44 and with the user peels away a removable cover film 80 with the other hand from the base section 20 thereby exposing a unit dose of a mass of the adhesive lavatory treatment composition 70 with the interior of the base section 20. The removable cover film 80 is discarded. In the next step depicted on FIG. 5B, the user grasping the grip element places the base section 20 against an inner sidewall 88 of a toilet bowl, and pushes the grip element 44 in the direction of arrow "A", and towards the sidewall which dispenses the mass of the adhesive lavatory treatment composition 70 from the applicator 10 and onto the sidewall 88. In the next step depicted on FIG. 5C, after the grip element 44 has been fully compressed and the mass of the adhesive lavatory treatment composition 70 has been adhered to the sidewall 88 as shown, the user has pulled the applicator 10 away from the deposited and adhered mass 70 and in the direction of arrow "B" and away from the sidewall. In the next (optional) step, the spent applicator 10 is properly disposed of, e.g. as recyclable plastic materials.

FIGS. 6A1, 6A2, 6A3, and 6A4 illustrate various view of a further embodiment of an applicator of the invention in a first configuration, and FIGS. 6B1, 6B2, 6B3 and 6B4 illustrate further view of the said applicator in a second configuration. The applicator 10 is a two-part applicator comprising a base section 20 movably engageable with a piston part 40. The piston part 40 comprises a piston plate 42, a grip element 44 in the shape of a paddle, a plurality of stop means 50, here, a number of outwardly extending elements forming part of the grip element 44, which cooperate with corresponding recesses or stop-notches 57 present in the sidewall 23 of the base section 20, which is bell shaped, and which further comprises a first or upper cavity 22 and a second or lower cavity 24, which terminates at a base face 26. The grip element 44 is depicted to be generally perpendicular to the base section 20, and is moveable with respect thereto. A plurality of inwardly extending tabs 59 extend inwardly from the sidewall 23 of the upper cavity 22 and are located above the piston plate 42 operate as piston removal stop means to prevent its withdrawal from and (easy) separation from the base section 20 when it is inserted into the base section 20. As is more clearly depicted on FIGS. 6A3 and 6A4, the base section 20 includes a first or upper cavity 22 is defined by a first sidewall 23, a bottom face 49 of the piston plate 42 and the second or lower cavity 24, which in turn is defined by a second circular sidewall 25, a transition section 27 which also delimits the interface between that first or upper cavity 22 and the second or lower cavity 24, and the base face 26. When the piston part 40 is moved in the direction of the base section 20, the stop means 50 present are dimensioned such that they enter into and are seated into their corresponding recesses or stop-notches 57 present in the sidewall 23 of the base section 20 such that further inward motion of the piston part 40 and its base section 20 is halted. In this preferred embodiment of the inventive device, the dimensions of the respective piston part 40, base section 20 and stop means 50 are selected such that the bottom face 49 of the piston plate 42 is coincident with the transition section 27 which delimits the interface between that first or upper cavity 22 and the second or lower cavity 24. Thus, little or no part of the piston part 40 is present within the second or lower cavity 24. Further visible, especially in FIGS. 6A3 and 6A4 is a single use "dose" of an adhesive lavatory treatment composition 70 within the applicator 10, and here is confined between the piston part 40 and is contained within the first or upper cavity 22, and terminates approximately at, or above, the transition section 27. FIGS. 6B1, 6B2, 6B3 and 6B4 illustrate a second configuration of the applicator 10 which figures respectively correspond to FIGS. 6A1, 6A2, 6A3 and 6A4, and are "paired" therewith. FIGS. 6B1, 6B2, 6B3 and 6B4 illustrate a configuration wherein the maximum movement of the piston part 40 into the base section 20 has taken place, the stop means 50 of the piston part 40 have entered into and are seated into their corresponding recesses or stop-notches 57 present in the sidewall 23 of the base section 20, such that the bottom face 49 of the piston plate 42 is coincident with the transition section 27 which delimits the interface between the first or upper cavity 22 and the second or lower cavity 24 and further wherein the mass of the adhesive lavatory treatment composition 70 is both in interfacial contact with the surface 90 as well as also being deformed laterally, as depicted. Such also demonstrates that in preferred embodiments, in a maximum compression configuration of the applicator as shown, little or no part of the piston part 40 is present within the second or lower cavity 24, and preferably little or no part of the composition 70 is adhered to the second or lower cavity 24. As will be best understood from the paired representations of FIGS. 6A3 and 6B3, and FIGS. 6A4 and 6B4, as depicted, in the first configuration of the device 10 the mass of the adhesive lavatory treatment composition 70 assumes the configuration of the first or upper cavity 22 whose area at the plane or interface between that first or upper cavity 22 is lesser than the area of the second or lower cavity 24 at the plane or interface with the plane face 26. Thus, the area of the bottom face 72 of the mass of an adhesive lavatory treatment composition 70 is necessarily lesser than that of the area of the second or lower cavity 24 at the plane or interface with the plane face 26. Further, as depicted on these figures the transverse dimensions between the sidewall(s) 25 of the second or lower cavity 24 are wider and/or longer than the transverse dimensions between the sidewall(s) 23 of the corresponding first or upper cavity 22. Thus the increased transverse width and/or transverse length provided in the second or lower cavity 24 permits for the mass of the adhesive lavatory treatment composition 70, when sufficiently compressed by the piston part 40 to deform laterally however desirably without coming into contact with the interior 28 of the sidewall(s) 25 of the second or lower cavity 24. Such provides for surprisingly reliable delivery of the mass of the adhesive lavatory treatment composition 70 to a surface.

The applicators may be manufactured or formed from any suitable material of construction. Advantageously, applicators are manufactured, such as by injection molding, from a suitable synthetic polymer. Nonlimiting examples of suitable synthetic polymer materials include, but are not limited to polyamides (e.g., nylons), polyolefins (e.g., polypropylene, polyethylene) as well as polyalkyleneterephalates (e.g., polyethylene terephthalate, polybutylene terephthalate), polystyrenes, polysulfones, polycarbonates as well as copolymers formed from monomers of one or more of the foregoing synthetic polymers. Other naturally occurring or synthetic but may also be used although not specifically described herein, it only being required that the selected polymer or copolymer be fabricable into applicators as described herein. Other formable materials, e.g., metals, paper such as coated papers may also be used in the manufacture of all or parts of the applicators taught herein. After being manufactured and when necessary, assembled, a quantity an adhesive lavatory treatment composition may be provided to part of said applicator, where it may be retained until it is subsequently dispensed from the applicator to a surface by a consumer.

Any of the parts, or surfaces of the applicator 10 may be formed of a release material, or may have applied thereto, a release material, e.g., a material which has poorer interfacial adhesivity with the treatment composition 70. Such a release material may be provided as a coating, e.g. to one or more parts of the applicator 10, e.g., to the piston plate 42 and/or first or upper cavity 22 and a second or lower cavity 24, or such a release material may also be provided as a further element or part of the applicator 10, e.g. a plate which may be fitted or positioned intermediate the piston plate 42 and the mass of the composition 42, or a sheet, film or cup which may be adhered to or fitted to one or more parts of the applicator 10. Such a release material may be present in the applicator 10 prior to it being supplied with the treatment composition 70.

Figure 5A:
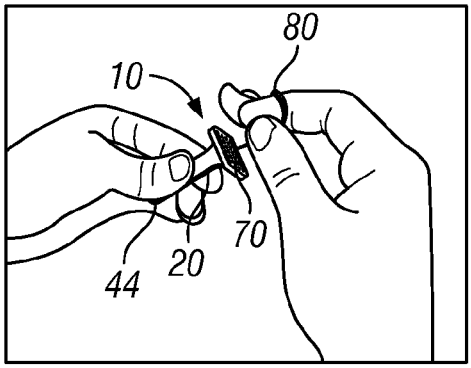
Figure 5B:
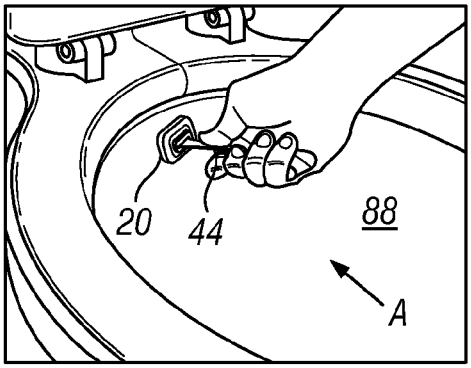
Figure 5C:
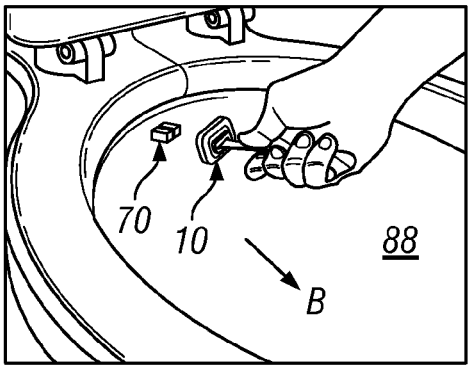
Figure 5D:
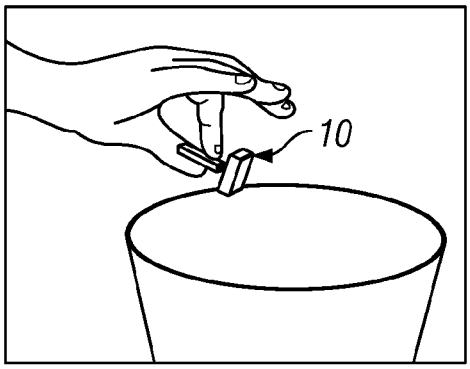

As discussed with reference to FIG. 5A, the applicator of the invention may further include a cover film or sheet of barrier material which advantageously spans the open base of the base section 20, and preferably is removably adhered to the base face 26. After manufacture of the applicator containing a mass of the adhesive lavatory treatment composition, such a cover film or sheet of barrier material may be applied to the applicator 10, such as across the open end of the base section 20 or lower cavity 24, e.g., may be applied to the base face 26. Such a cover film or sheet of barrier material may be of any suitable material, e.g., a synthetic polymer material, a metal or metallic foil or film, a metallized polymer film, multilayered materials, e.g., comprising at least two polymer layers and/or at least one polymer layer and at least one further layer such as a paper, cardboard, foil, metallic film and the like. The cover film or sheet of barrier material may be applied to the applicator using a suitable adhesive. Additionally or alternately the cover film or sheet of barrier material may be a rigid article, such as a cover or cap which may be fitted onto or adhered onto the applicator and removed prior to delivery of the adhesive lavatory treatment composition from the applicator.

Dispensers of the invention may be packaged and sold as single vendible articles, or a plurality of such applicators may be packed and sold as a vendible article. In the case of the latter, the plurality of applicators are supplied in suitable packaging, e.g., in a tray or container which may be resealable by a consumer.

While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents and alternatives falling within the scope and spirit of the invention as expressed in the appended claims.

The invention claimed is:

1. A single use applicator for an adhesive lavatory composition which comprises:

a single dose of an adhesive lavatory composition, a piston part moveably engageable within a base part, wherein:

the piston part includes a piston plate, a grip element and stop means, and, the base part includes an upper cavity containing the single dose of the adhesive lavatory composition, and a lower cavity, and, wherein the piston plate is fitted within the upper cavity of the base part and is moveable within the upper cavity of the base part only between a first position and a second position and wherein the stop means is engaged when the piston plate is in the second position thus denying further movement of the piston plate relative to the base part, wherein in the said first position, the piston part is positioned within the base part such that the single dose of adhesive lavatory composition is present only in the upper cavity; and, in the said second position, the piston part is positioned within the base part such that substantially all of the dose of the adhesive lavatory treatment composition is expelled from the upper cavity and into the lower cavity; and, wherein the cross-sectional area of the transverse of the upper cavity is less than the cross-sectional area of the transverse of the lower cavity.

2. An applicator according to claim 1, wherein the grip element is generally perpendicular to the base section.

3. An applicator according to claim 1, wherein the piston plate comprises a release material.

4. An applicator according to claim 3, wherein the release material comprises a film.

5. A method of applying an adhesive lavatory composition to a surface the method comprising the steps of:

supplying an applicator according to claim 1 containing a single dose of an adhesive lavatory treatment composition, applying the single dose of the adhesive lavatory treatment composition from the applicator to a surface.

6. An applicator according to claim 1, wherein the base part is bell-shaped.

7. An applicator according to claim 1, wherein the base part includes a transition section between the between the upper cavity and the lower cavity and wherein the upper cavity defines a piston bore, which piston bore is narrower above the transition section, than below the piston section.

8. An applicator according to claim 1, wherein the volume of the upper cavity is less than the volume of the lower cavity.

9. An applicator according to claim 1, wherein when the piston plate is in the second position, little or no part of the adhesive lavatory composition is adhered to the lower cavity.

10. An applicator according to claim 1, which further comprises a cover film or sheet of barrier material which spans an open end of the base part.

* * * * *